United States Patent [19]

Szeles

[11] 3,940,009

[45] Feb. 24, 1976

[54] TRUCK BOX

[76] Inventor: Julius Szeles, 1403-10th Ave., Regina, Saskatchewan, Canada

[22] Filed: Aug. 26, 1974

[21] Appl. No.: 500,718

[30] Foreign Application Priority Data

Aug. 28, 1973 Canada ..... 179795

[52] U.S. Cl. ..... 220/20; 296/37 R

[51] Int. Cl.[2] ..... B65D 87/00

[58] Field of Search ... 220/20, 22; 224/29 R, 42.32; 296/24 R, 37 R; 137/351, 354, 356

[56] References Cited

UNITED STATES PATENTS 3,640,423 2/1972 Parker et al. ..... 296/37 R X 3,854,621 12/1974 Parry..... 296/37 R X

*Primary Examiner*—William I. Price

*Assistant Examiner*—Steven M. Pollard

*Attorney, Agent, or Firm*—Stanley G. Ade

[57] ABSTRACT

Normally tools, spare tires, wheels, gas cans and the like are stored in the open truck box where they can be stolen or interfered with. Also they are exposed to all weather conditions. The box of the present invention fits across the front of the open truck box and includes one or two fuel tanks, storage for the spare wheel and tire and storage space for tools such as a jack, etc. A hinged lid covers all of these items when closed and the lid may be locked to prevent theft and also to protect the contents from the elements.

2 Claims, 3 Drawing Figures

TRUCK BOX

BACKGROUND OF THE INVENTION

The spare tire, wheel and various tools such as the jack, etc. are normally carried within the open box of a truck and, when used in farm work, spare containers of the fuel for farm implements and the like are also carried loosely within the box.

These items are easily stolen or interfered with as they are not capable of being protected and furthermore they are exposed to the elements unless a tarpaulin is used.

SUMMARY OF THE INVENTION

The present invention overcomes these disadvantages by providing a storage box adapted to fit across the front end of the open box of the truck and to contain one or more fuel tanks, storage space for the spare wheel and tire, the jack and other tools, said box having a hinged lid which may be closed and locked when not in use.

The principal object and essence of the invention is therefore to provide a heavy duty rugged storage box for fuel, tools and the spare wheel and tire of a truck.

Another object of the invention is to provide a device of the character herewithin described in which the contents of the box are readily locked to prevent theft from occurring.

Another object of the invention is to provide a device of the character herewithin described which may include pump means for pumping the fuel from the fuel tank to an adjacent farm implement or the like.

Still another object of the invention is to provide a device of the character herewithin described which encloses the spare wheel and tire and prevents damage occurring thereto often caused by objects carried within the truck box.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
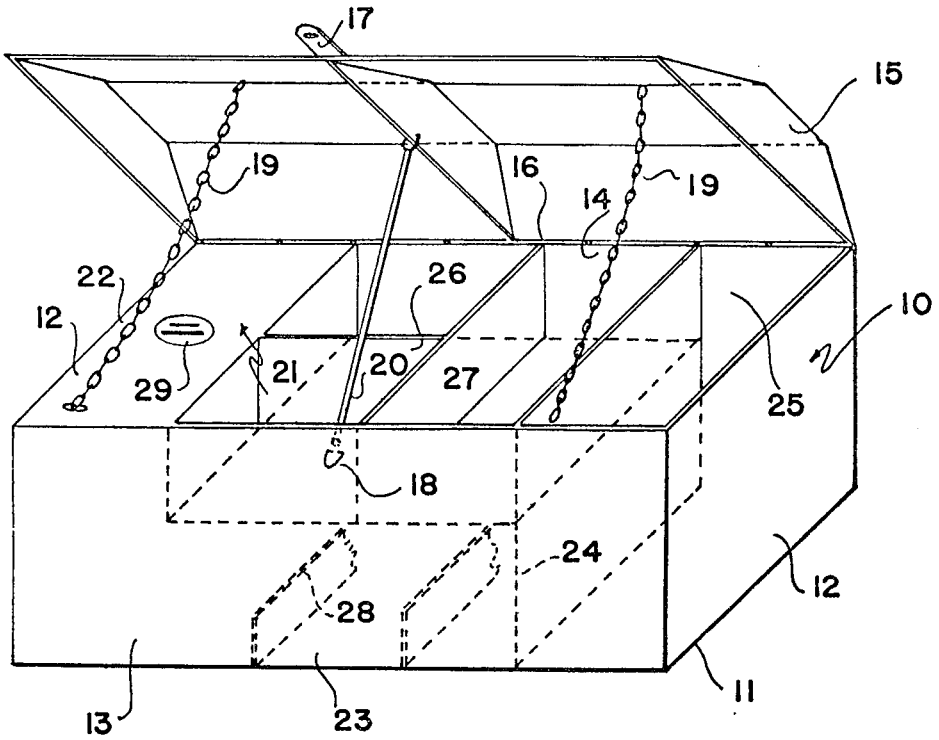
FIG. 1 shows an isometric view of one embodiment of the invention.

Proceeding therefore to describe the invention in detail, reference character 10 illustrates the box in general which is preferably manufactured from heavy gauge steel sheet and includes a rectangular base 11, end walls 12, a front wall 13 and a rear wall 14.

A reinforced lid 15 is hinged by one edge thereof along the upper edge 16 of the rear wall 14 and normally encloses the open upper side of the box when not in use. A hasp 17 engages a hoop 18 on the front panel 13 and a padlock (not illustrated) may engage the hasp and hoop to lock the lid in the closed position.

Check chains 19 are provided between the lid and the box to limit the upward movement of the lid and a detachable brace rod 20 engages between the lid and the front panel 13 as clearly illustrated to maintain the lid in the open position when desired.

In this embodiment, a fuel tank collectively designated 21 is provided and built into the box, said fuel tank being substantially L-shaped and having one leg 22 situated at one end of the box with the other leg 23 extending across the lower portion of the box but terminating spaced from one end wall 12 as indicated by the end wall 24 of the fuel tank.

This end wall of the fuel tank which extends upwardly to the upper edge of the box, together with the end wall 12 of the box and the portions of the front and back panels, defines a vertically situated space 25 within which a spare tire and wheel (not illustrated) may be stored.

The remaining area of the box is provided with partitions 26 and 27 dividing this area into storage spaces for various tools, a jack and handle, and if desired, a manually operated fuel pump, none of which are illustrated in the drawings.

Various baffles 28 are provided within the fuel tank to prevent undue movement of the fuel contained within the tank and this tank is provided with a filler cap 29 within the upper side of the leg 22 thereof.

Figure 2:
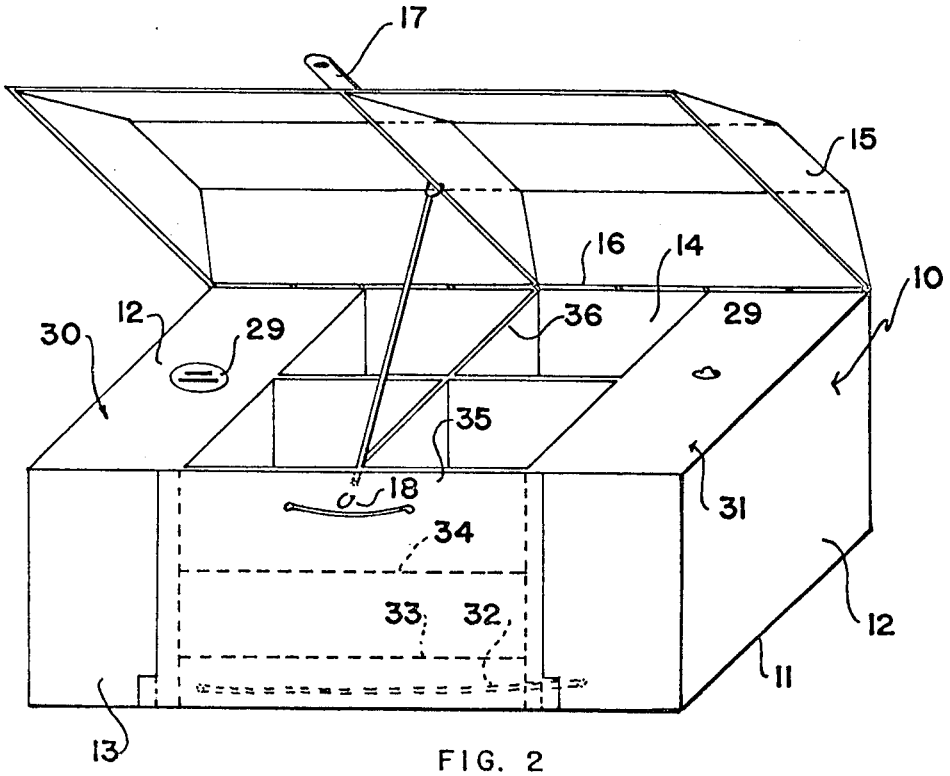
FIG. 2 shows an isometric view of a further embodiment of the invention.

FIG. 2 is similar in construction to FIG. 1 with the exception that two fuel tanks are provided one at each end of the box and these fuel tanks are identified by the reference characters 30 and 31.

If necessary a cross hose shown in phantom by reference character 32 may extend across the box and connect the two tanks if a similar fuel is carried by these tanks. Alternatively, gasoline may be carried in one and fuel oil in the other depending upon the desires of the operator.

In this particular embodiment, a pair of horizontal partitions 33 and 34 span the area between the tanks with the spare tire and wheel (not illustrated) being stored between the two partitions and the jack and other tools being stored between the lowermost partition 33 and the base 11. In this regard a sliding door assembly 35 is formed in the front panel 13 extending between the inner walls of the two tanks which may be removed for access to the tools and/or tire and wheel assembly.

The portion above the upper partition 34 may be divided by cross partitions 36 and used for general storage purposes.

Figure 3:
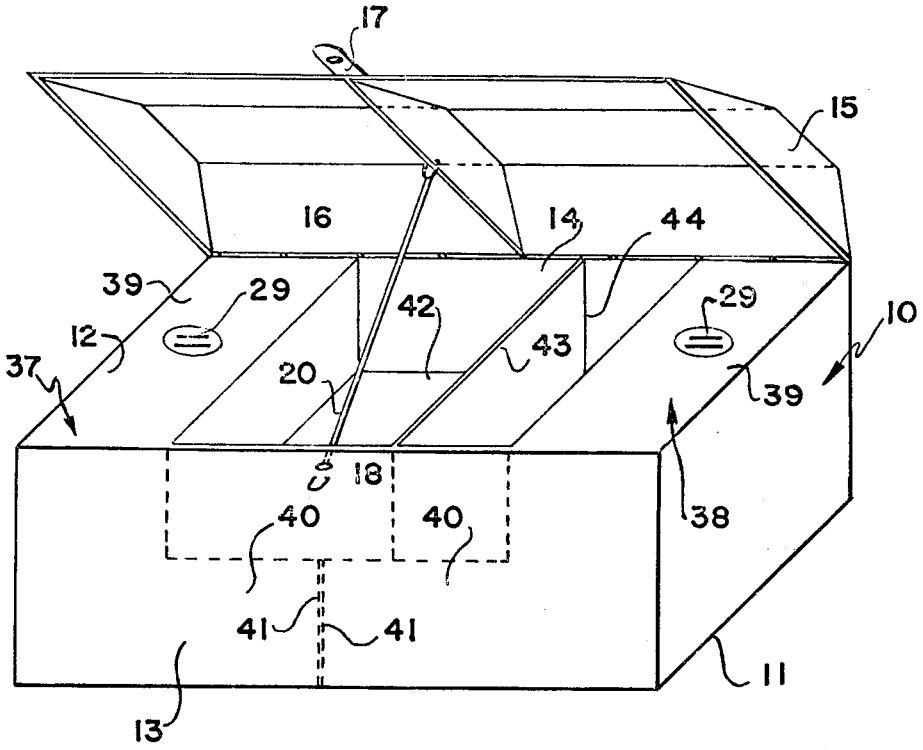
FIG. 3 shows an isometric view of a still further embodiment of the invention.

The embodiment shown in FIG. 3 also includes two tanks, defined in this embodiment by reference characters 37 and 38. They are both L-shaped with the one leg 39 being situated at each end of the box and the other leg 40 extending towards one another and forming the lower portion of the box and terminating adjacent one another by the inner walls thereof as indicated by the reference character 41.

This defines a rectangular area 42 which may be utilized for the storage of the spare tire and wheel assembly and a vertical partition 43 defines a further tool storage area 44 as clearly illustrated.

The tanks may either be interconnected (not illustrated) or may carry different fuels and a conventional wobble pump may be installed in any of the tanks for ease of pumping out the fuel to convenient farm implements or containers as desired.

All embodiments may of course be locked securely as hereinbefore described and, when the lids are closed, the contents are protected from the elements.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A box for use in open truck boxes and adapted to receive a spare tire and wheel comprising an open topped enclosure, cover means secured to the enclosure and adapted to selectively enclose the open top, at least one fuel storage tank formed within said box having a filler cap thereon, a divider in said box defining with said box and said tank, a tire and wheel storage area for the receipt and storage of the associated spare tire and wheel and tool storage areas also formed in said box, said fuel tank comprising an L-shaped fuel tank, one leg of said tank lying at one end of said box, the other leg of said fuel tank extending across the lower portion of said box and terminating spaced from the other end of said box, the space defined by the distal end of said other leg and the adjacent end wall of said box forming said tire and wheel storage area adapted to receive the associated spare tire and wheel vertically therein.

2. A box for use in open truck boxes and adapted to receive a spare tire and wheel comprising an open topped enclosure, cover means secured to the enclosure and adapted to selectively enclose the open top, at least one fuel storage tank formed within said box having a filler cap thereon, a divider in said box defining with said box and said tank, a tire and wheel storage area for the receipt and storage of the associates spare tire and wheel and tool storage areas also formed in said box, said fuel tanks comprising a pair of L-shaped fuel tanks, one leg of each of said tanks lying at each end of said box, the other legs of said tanks extending across the lower portion of said box and terminating adjacent one another, the associates spare tire and wheel lying horizontally within said box upon said other legs of said tanks.

* * * * *